US007311375B2

(12) United States Patent
Suzuki et al.

(10) Patent No.: US 7,311,375 B2
(45) Date of Patent: Dec. 25, 2007

(54) CAP MEMBERS AND LIQUID EJECTING DEVICES COMPRISING CAP MEMBERS

(75) Inventors: Ryohei Suzuki, Nagoya (JP); Kohei Terada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/277,446

(22) Filed: Mar. 24, 2006

(65) Prior Publication Data

US 2006/0221120 A1 Oct. 5, 2006

(30) Foreign Application Priority Data

Mar. 30, 2005 (JP) ..... 2005-099263

(51) Int. Cl.
*B41J 2/165* (2006.01)

(52) U.S. Cl. ..... 347/29; 347/30; 347/32

(58) Field of Classification Search ..... 347/22, 347/29, 30, 33
See application file for complete search history.

(56) References Cited

U.S. PATENT DOCUMENTS 6,471,330 B1 10/2002 Umeda et al.
6,883,896 B2 4/2005 Umeda

FOREIGN PATENT DOCUMENTS

JP 1995125243 A 5/1995
JP 2001347677 A 12/2001
JP 2004106433 A 4/2004

*Primary Examiner*—Shih-Wen Hsieh
(74) *Attorney, Agent, or Firm*—Baker Botts L.L.P.

(57) ABSTRACT

A cap member for covering a plurality of nozzle arrays disposed in a nozzle plate of a liquid ejecting head includes a first lip, at least one second lip, and a main body. The first lip has an annular shape and is configured to abut against the nozzle plate to enclose the plurality of nozzle arrays. At least one second lip has an annular shape, is disposed within the annular first lip, and is configured to abut against the nozzle plate to enclose at least one of the plurality of nozzle arrays separately from the first lip. The first lip and the at least one second lip are disposed on the main body. The main body is configured to cooperate with the first lip and the at least one second lip to make sealing contact with the nozzle plate.

12 Claims, 12 Drawing Sheets

RELATED ART

CAP MEMBERS AND LIQUID EJECTING DEVICES COMPRISING CAP MEMBERS

CROSS REFERENCE TO RELATED APPLICATION

The present application claims priority from Japanese Patent Application No. 2005-099263 which was filed on Mar. 30, 2005, the disclosure of which is incorporated herein by reference in its entirety.

BACKGROUND OF THE INVENTION

1. Field of the Invention

The present invention relates generally to a cap member for covering a plurality of nozzle arrays formed in a nozzle plate of a liquid ejecting head, and also relates generally to a liquid ejecting device comprising such a cap member.

2. Description of Related Art

As an example of liquid ejecting devices, inkjet recording devices capable of color recording using inks of a plurality of colors (such as black, yellow, cyan, and magenta) are known. In such known inkjet recording devices, arrays of nozzles for ejecting respective color inks are provided in a nozzle plate of an inkjet head. A cap member also is provided to enclose and cover the nozzle openings to prevent the ink in the nozzles from drying up or hardening, or both, when the inkjet recording device is kept in the non-recording mode, i.e., in the standby mode.

For example, as shown in FIGS. 11A and 11B, a cap member 90 having two annular lips 91, 92 is used in a 4-color inkjet recording device, as disclosed in U.S. Pat. No. 6,883,896 B2. Lips 91, 92 cover separate four nozzle arrays 10*h*, 10*i*, 10*j*, 10*k*, which are divided into two segments. Lip 91 covers nozzle array 10*h*, while lip 92 covers the other three nozzle arrays 10*i*, 10*j*, 10*k*. The four nozzle arrays are divided into two segments, so that ink is withdrawn separately from the two segments, thus, reducing the amount of waste ink. When an ink ejection failure occurs in any nozzle of the inkjet recording device, ink is withdrawn from the nozzles under negative pressure by a maintenance mechanism to restore ejection performance of the nozzles. In this case, if ink is withdrawn by covering all the nozzle arrays with a single lip, ink is withdrawn from all the nozzle arrays regardless of whether or not each nozzle array includes faulty nozzles, resulting in an increase in the amount of waste ink.

As described above, if four nozzle arrays 10*h*, 10*i*, 10*j*, 10*k* are divided into two segments, and if two lips 91, 92 are provided separately for the respective segments a portion of lip 91 and a portion of lip 92, which are parallel with the nozzle arrays, are disposed at a boundary portion between two adjacent nozzle arrays 10*h*, 10*i*, as shown in FIG. 11B. In this case, a distance d between two adjacent nozzle arrays 10*h*, 10*i* may resist reduction below a certain limit. Lips 91, 92 experience reduced rigidity and collapse during ink withdrawal if lips 91, 92 are made with a reduced width to decrease distance d. Consequently, a gap is created between lip 91 and the nozzle plate or between lip 92 and the nozzle plate, making ink withdrawal under negative pressure difficult or impossible.

Alternatively, a compact inkjet head, as well as a compact inkjet recording device, in which nozzle arrays are arranged at reduced intervals and at high density is desired. For example, a cap member 100 as shown in FIG. 12A is known. Cap member 100, as described in U.S. Pat. No. 6,471,330 B2, has a lip 101 and a lip 102 that integrally intersect with each other at a portion E and share a partition wall 103 disposed therebetween. Accordingly, a single partition wall 103 is disposed at a boundary portion between two adjacent nozzle arrays.

Nevertheless, in cap member 100, it may be difficult to make lips 101, 102 flush with each other. As shown in FIG. 12B, lips 101, 102 and partition wall 103 are connected at the portion E because potions of lips 101, 102 share partition wall 103. When such a cap member is made by injection molding, grooves for lips are machined into the mold. Because a tool to cut such grooves passes the intersection (i.e., joint) twice, it is difficult to make the depth of the intersecting grooves the same, and a relatively small step may be formed at the bottoms of the intersecting grooves. Consequently, a difference in height h (i.e., a step) is created at the intersection of lips 101, 102 and the flushness between the uppermost surfaces of lips 101, 102 is not ensured.

Even if the cap member having such a step at the intersection of the lips is pressed against the nozzle plate, a clearance may be created between the lip and the nozzle plate, such that the cap member fails to make sealing contact with the nozzle plate. Such a clearance may be eliminated by forcibly contacting the cap member with the nozzle plate. This measure, however, may require use of a greater power source and an increased rigidity of the inkjet recording device, leading to an increase in the production cost.

SUMMARY OF THE INVENTION

Therefore, a need has arisen for cap members that overcome these and other shortcomings of the related art. A technical advantage of the present invention is that a cap member is brought into sealing contact with a nozzle plate with a relatively small force, and that the cap member may be used for a liquid ejecting head of a liquid ejecting device in which nozzle arrays are arranged at relatively small intervals in order to make the head, as well as the device, compact.

According to an embodiment of the invention, a cap member for covering a plurality of nozzle arrays formed through a nozzle plate of a liquid ejecting head comprises a first lip, at least one second lip, and a main body. The first lip has an annular shape and is configured to abut against the nozzle plate to enclose the plurality of nozzle arrays. The at least one second lip has an annular shape, is disposed within the annular first lip, and is configured to abut against the nozzle plate to enclose at least one of the plurality of nozzle arrays separately from the first lip. The first lip and the at least one second lip are disposed on the main body. The main body is configured to cooperate with the first lip and the at least one second lip to make sealing contact with the nozzle plate.

With this structure, the at least one second lip abuts against the nozzle plate within the first lip to enclose a portion of the plurality of nozzle arrays separately from the first lip. A portion of the at least one second lip, which is parallel with the nozzle arrays, abuts against the nozzle plate at a boundary portion defined between two adjacent nozzle arrays. Accordingly, an interval between the two adjacent nozzle arrays may be reduced. Consequently, the plurality of nozzle arrays may be arranged in higher density in the nozzle plate, thereby enabling a reduction in the size of the liquid ejecting head and production of the liquid ejecting head at reduced cost.

According to another embodiment of the invention, the above-described cap member may be incorporated into a liquid ejecting device. The liquid ejecting device comprises a liquid ejecting head that has a nozzle plate formed with a plurality of nozzle arrays and ejects a liquid from the nozzle arrays.

In this liquid ejecting device, withdrawal of liquid for restoring ejection performance of the nozzles may be performed by enclosing the nozzle arrays with the cap member, while reducing the amount of waste liquid. Further, the cap member allows the nozzle arrays to be arranged at relatively small intervals, enabling a reduction in the size of the liquid ejecting head, as well as the liquid ejecting device.

Other advantages of the present invention will be apparent to persons skilled in the art in view of the following detailed description of the invention and the accompanying drawings.

BRIEF DESCRIPTION OF THE DRAWINGS

For a more complete understanding of the present invention, and the needs satisfied thereby, reference now is made to the following descriptions taken in connection with the accompanying drawings.

DETAILED DESCRIPTION OF PREFERRED EMBODIMENTS

Preferred embodiments of the present invention may be understood by referring to FIGS. 1-10, like numerals being used for like corresponding parts in the various drawings.

Figure 1:
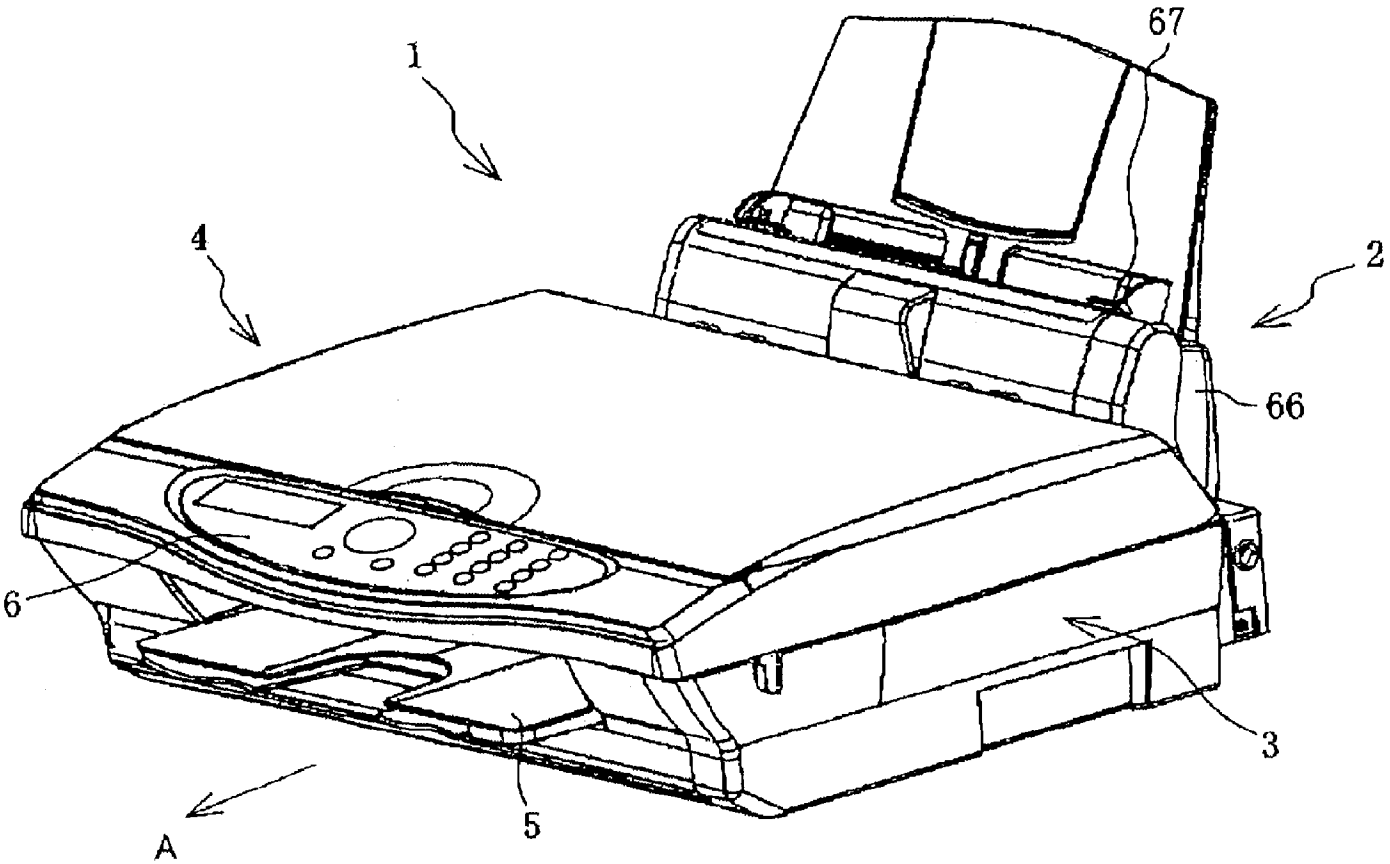
FIG. 1 is a perspective view of a multifunction device.

FIG. 1 shows a multifunction device 1 according to an embodiment of the present invention. Multifunction device 1 has printing, copying, scanning, facsimile, and telephone functions. As shown in FIG. 1, multifunction device 1 has a sheet feeder 2 at its rear, and has a printer 3 as an inkjet recording device at a front lower side of the sheet feeder 2. Further, multifunction device 1 has a reading unit 4 that performs copying, scanning, and facsimile functions. A discharged sheet tray 5 is disposed at a front side of printer 3, and an operation panel 6 is provided on an upper surface of a front end of reading unit 4.

Sheet feeder 2 is provided with an inclined wall portion 66 for supporting sheets at an inclined orientation, and a sheet guide 67 detachably attached to inclined wall portion 66 to guide the sheets. A sheet feed motor (not shown) and a sheet feed roller (not shown) are housed within inclined wall portion 66. The sheet feed roller driven by sheet feed motor feeds the sheets toward printer 3.

Figure 2:
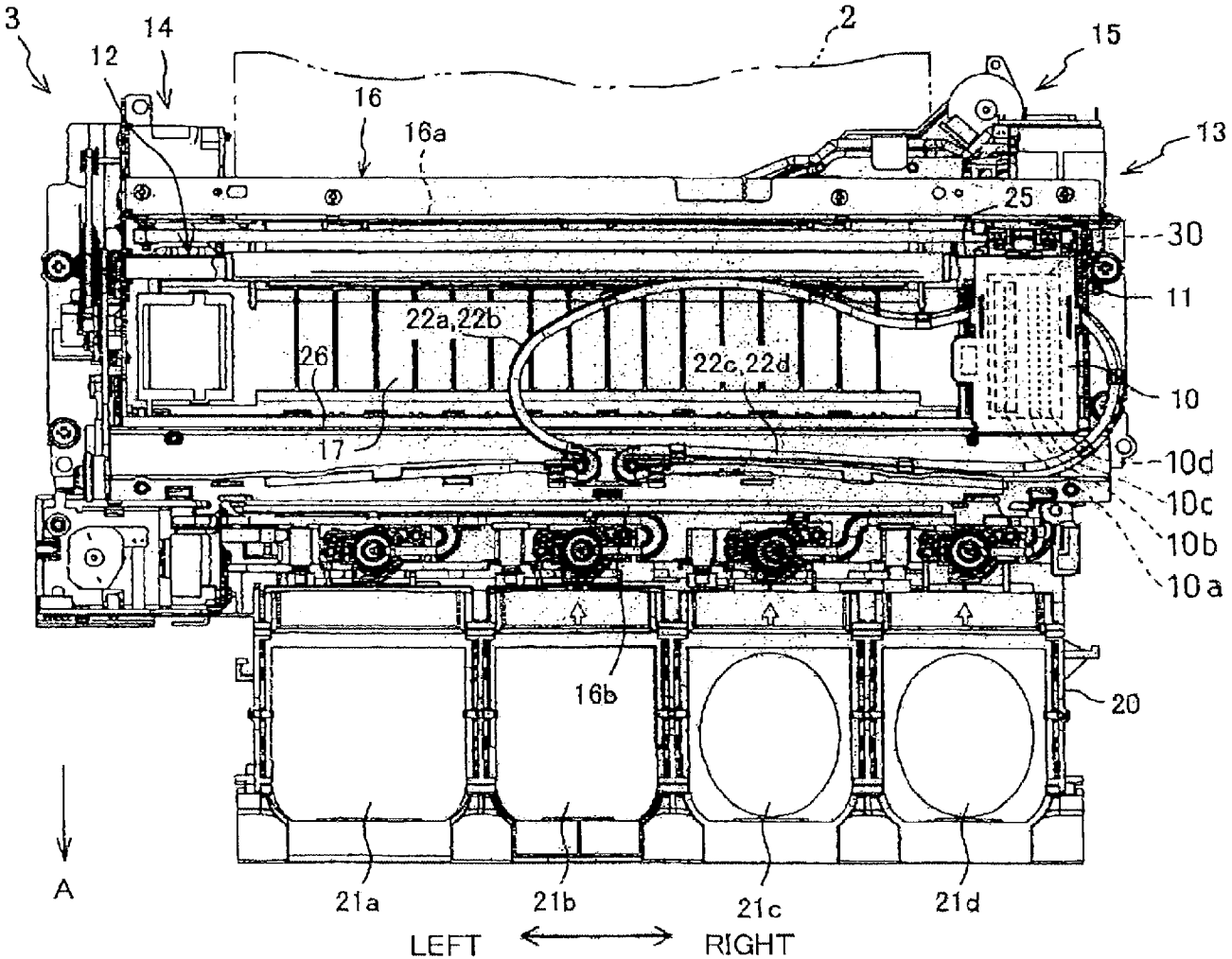
FIG. 2 is a cross-sectional view showing an inner structure of a printer of the multifunction device.

As shown in FIG. 2, printer 3 includes a recording head 10, a carriage 11 on which recording head 10 is mounted, a guide mechanism 12 that supports carriage 11 movably in a right-left direction (e.g., a primary scanning direction), a carriage moving mechanism 13 that moves carriage 11 in the right-left direction, a sheet conveying mechanism 14 that conveys the sheets fed by sheet feeder 2, and a maintenance mechanism 15 for recording head 10.

Printer 3 may have a parallelepiped frame 16 wider in the right-left direction and narrower in vertical dimension. Guide mechanism 12, carriage moving mechanism 13, sheet conveying mechanism 14, and maintenance mechanism 15 are attached to frame 16. Recording head 10 and carriage 11 are accommodated in frame 16 so as to be movable reciprocally in the right-left direction.

Frame 16 is formed with a sheet inlet (not shown) at its rear plate 16*a* and a sheet outlet (not shown) at its front plate 16*b*. Referring to FIG. 1, the sheet fed from sheet feeder 2 is guided into the inside of frame 16 through the sheet inlet, conveyed frontward (e.g., in a direction of arrow A) by sheet conveying mechanism 14, and discharged from the sheet outlet onto discharged sheet tray 5. A platen 17 comprising a plurality of ribs is attached to a bottom surface of frame 16. Recording head 10 inside frame 16 performs recording (e.g., image forming) on the sheet being conveyed on platen 17.

Figure 3A:
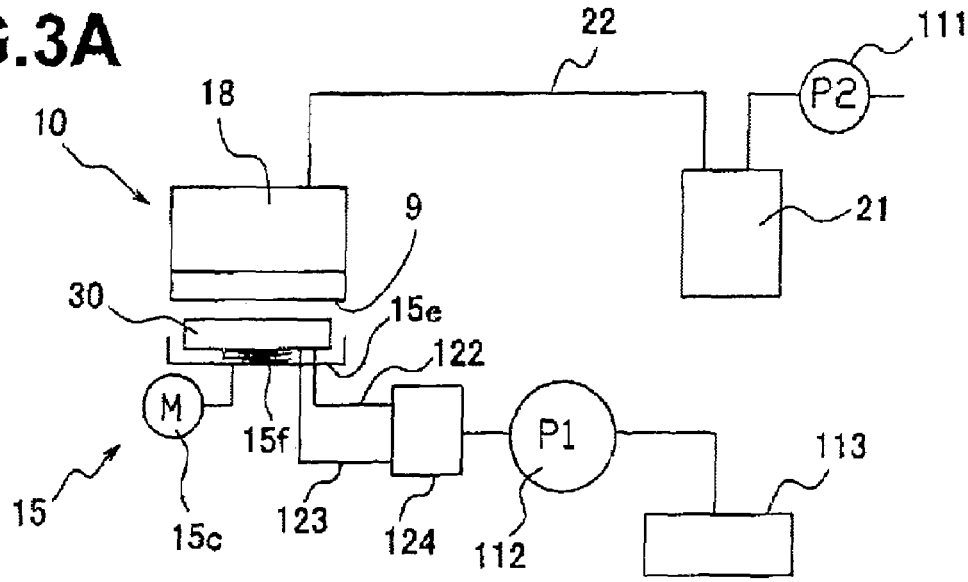
FIG. 3A is a schematic diagram showing a maintenance mechanism in which a cap member is away from a recording head when the recording head is in the recording mode.

Ink cartridges 21*a*-21*d* including four color inks are mounted on a cartridge mount 20 in front of frame 16 and are connected respectively to recording head 10 via four flexible ink tubes 22*a*-22*d* that pass inside frame 16. Referring to FIG. 3A, inks of four colors are pressurized by a pressurizing pump 111 and supplied to recording head 10.

Recording head 10 of printer 3 now is described. As shown in FIG. 2, four ink nozzle arrays 10*a*-10*d* are provided, such that nozzle holes formed therein are open downward (e.g., toward a backside of the sheet of FIG. 2). Inks of four colors (e.g., black, cyan, yellow, and magenta) are ejected downward from nozzle arrays 10*a*-10*d*, thereby forming an image on the sheet. The four arrays of ink nozzles 10*a*-10*d*, which are provided on a lower side of recording head 10, are indicated by a dotted line in the cross-sectional view in FIG. 2.

FIG. 3 is a schematic diagram showing a general structure of maintenance mechanism 15. Maintenance mechanism 15 comprises a cap member 30, a cap holder 15*e*, and a drive motor 15*c*, and performs maintenance on recording head 10 comprising the four ink nozzle arrays 10*a*-10*d*.

FIG. 3A shows a state in which cap member 30 is distal to recording head 10, which is in the recording mode. As shown in FIG. 3A, a sub tank 18 for a corresponding ink color is housed within recording head 10, and sub tank 18 is in liquid communication with corresponding ink cartridge 21 via corresponding ink tube 22. Ink in ink cartridge 21 is delivered to sub tank 18 by pressurizing pump 111.

Cap member 30 is retracted to a lower position than a nozzle plate 9 of recording head 10. Cap member 30 is attached to cap holder 15*e* via an elastic member 15*f*. Cap holder 15*e* is driven by drive motor 15*c* vertically and is movable between a position in which cap member 30 is in close contact with nozzle plate 9 of recording head 10 and a position in which recording head 10 is distal to nozzle plate 9.

Figure 3B:
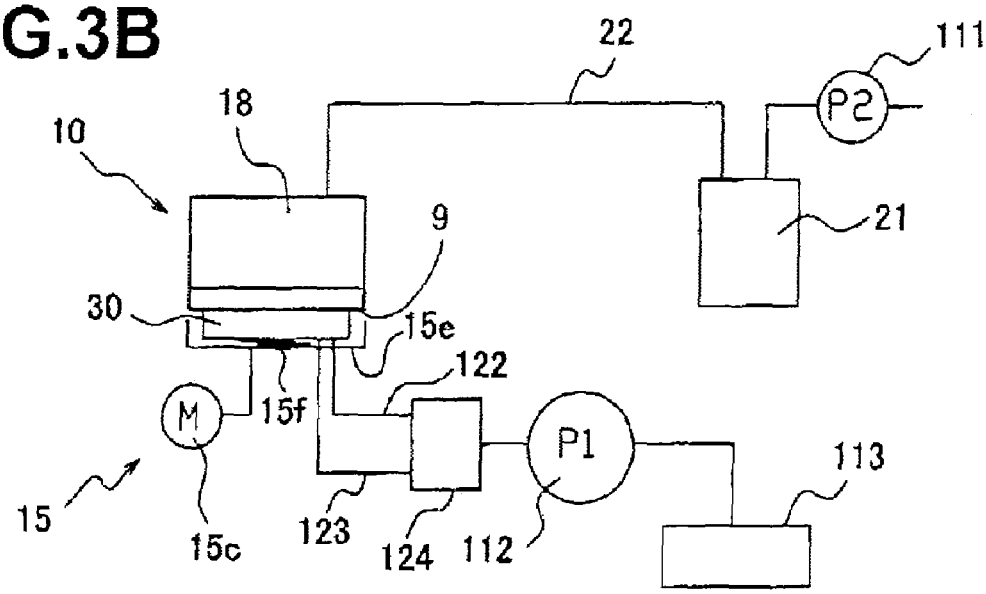
FIG. 3B is a schematic diagram showing the maintenance mechanism in which the cap member is in contact with a nozzle plate of the recording head when the recording head is in the ejection performance restoration mode or in the standby mode.

FIG. 3B shows a state in which cap member 30 is in sealing contact with nozzle plate 9 of recording head 10, which is in the ejection performance restoration mode or in the standby mode. Cap member 30 is moved upward by drive motor 15*c* to abut against nozzle plate 9 of recording head 10, and is urged toward recording head 10 by elastic member 15*f* to enclose nozzle arrays formed through nozzle plate 9. In this condition, suction pump 112 is operated to draw ink from the nozzle arrays via tubes 122, 123 and a switching unit 124 to restore ejection performance. The ink withdrawn is collected in a waste ink container 113. Although FIGS. 3A and 3B show that cap member 30 is disposed on the holder 15*e* via elastic member 15*f*, actually a support member (not shown), to which cap member 30 is fixed, is disposed elastically on cap holder 15*e* via elastic member 15*f*.

Figure 4A:
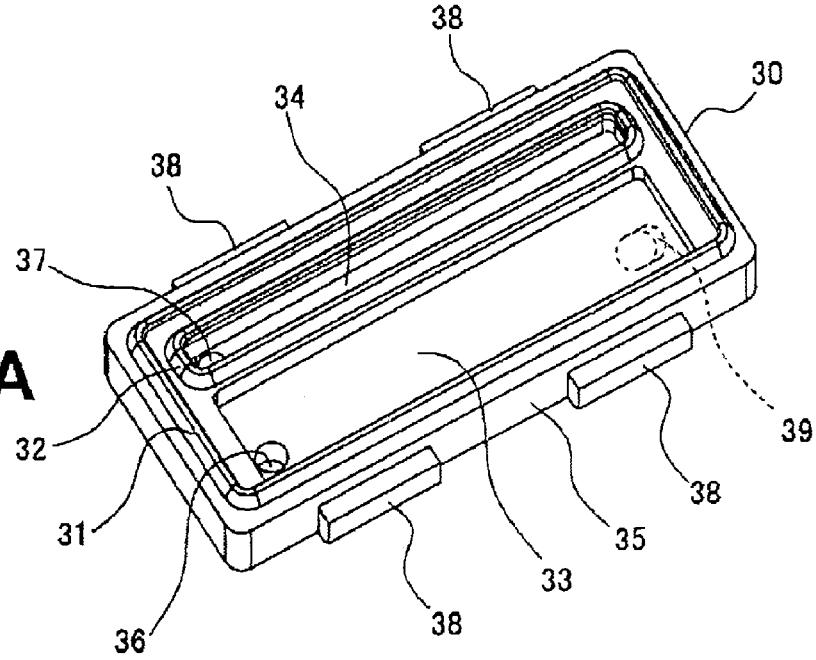
FIG. 4A is a perspective view of a cap member according to an embodiment of the present invention, as viewed from a side where lips are formed.
Figure 4B:
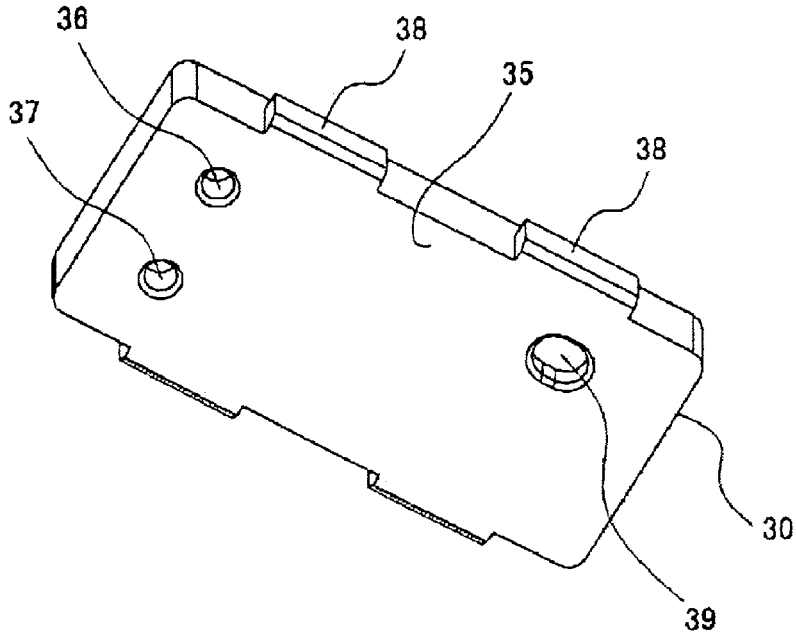
FIG. 4B is a perspective view of the cap member as viewed from a side opposite to the lips.
Figure 5A:
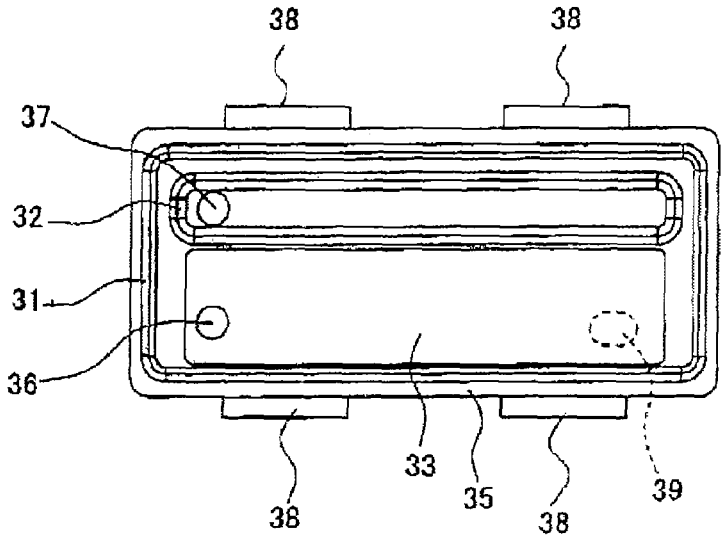
FIG. 5A is a plan view of the cap member.
Figure 5B:
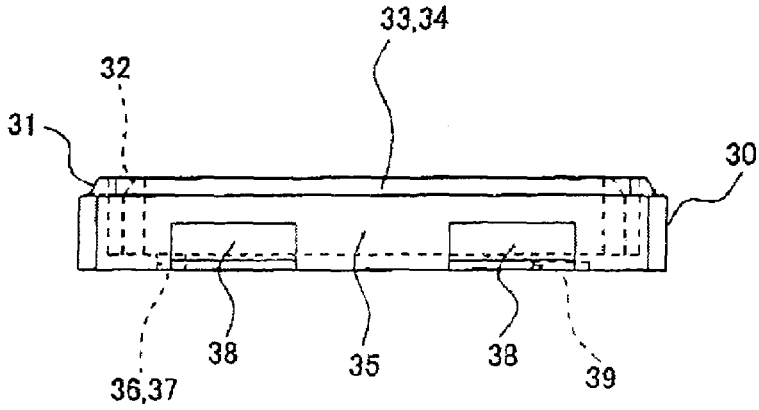
FIG. 5B is a longitudinal side view of the cap member.

FIGS. 4 and 5 show cap member 30. FIG. 4A is a perspective views of a cap member 30 as viewed from a side on which lips 31, 32 are formed, and FIG. 4B is a perspective view of the cap member 30 as viewed from a side opposite to lips 31, 32. FIG. 5A is a plan view of cap member 30, and FIG. 5B is a longitudinal side view of cap member 30.

As shown in FIGS. 4A and 4B, cap member 30 is of a parallelepiped box shape and is uncovered, and has a flat, plate-like main body 35. As shown in FIG. 5A, main body 35 has a substantially rectangular shape in plan view. A first lip 31 having an annular shape is disposed on main body 35 to extend along the side edges of main body 35. A surface of main body 35 opposed to the nozzle plate 9 and first lip 31 define a first enclosed space 33. When cap member 30 makes sealing contact with nozzle plate 9, the first enclosed space 33 is in communication with the nozzle arrays 10*b*-10*d*. A second lip 32 having an annular shape is disposed within first lip 31 on the main body 35, separately from first lip 31. The surface of main body 35 opposed to nozzle plate 9 and second lip 32 define a second enclosed space 34. When cap member 30 makes sealing contact with nozzle plate 9, second enclosed space 34 is in communication with nozzle array 10*a*.

Four parallelepiped ribs 38 are formed integrally with main body 35 to protrude externally from the side surfaces of main body 35. Ribs 38 serve as mounting pieces when cap member 30 is mounted on the support member (not shown). Ribs 38 are fitted into grooves formed in the support member, and thereby cap member 30 is fixed to the support member. The support member, to which cap member 30 is fixed, may be disposed on cap holder 15*e* elastically via elastic member 15*f*.

A shallow hole 39 is formed in a surface of main body 35 opposite from the surface formed with lips 31, 32. Hole 39 is a positioning hole when cap member 30 is mounted on the supporting member.

A plurality of holes 36, 37 are formed through the surface of main body 35 opposed to nozzle plate 9. First enclosed space 33 encompasses hole 36 through which first enclosed space 33 communicates with the outside of cap member 30. Hole 36 is an air and waste ink suction hole when ink is withdrawn from nozzle arrays 10*b*-10*d* to restore ejection performance while first lip 31 is in sealing contact with nozzle plate 9. Similarly, second enclosed space 34 encompasses hole 37 through which second enclosed space 34 communicates with the outside of cap member 30. Hole 37 is an air and waste ink suction hole when ink is withdrawn from nozzle array 10*a* to restore ejection performance while second lip 32 is in sealing contact with nozzle plate 9. The support member for supporting cap member 30 is provided with two suction fittings to be connected at one end to holes 36, 37, respectively. The suction fittings also are connected at the other end to tubes 122, 123, respectively.

Tubes 122, 123 are connected to suction pump 112 via switching unit 124, and ink is withdrawn via one of tubes 122, 123 selected by switching unit 124 when suction pump 112 is operated. Accordingly, restoration of ejection performance may be carried out selectively for nozzle arrays 10*b*-10*d* enclosed by first lip 31 and for nozzle array 10*a* enclosed by second lip 32. By such selective ink withdrawal, instead of collective ink withdrawal in which ink is drawn from the all of the nozzle arrays, the amount of waste ink may be reduced. Alternatively, instead of providing switching unit 124, suction pump 112 and another suction pump (not shown) may be provided for tubes 122, 123, respectively.

Main body 35, first lip 31, and second lip 32 of cap member 30 are formed integrally with each other from an elastic material, such as butyl rubber.

Figure 6:
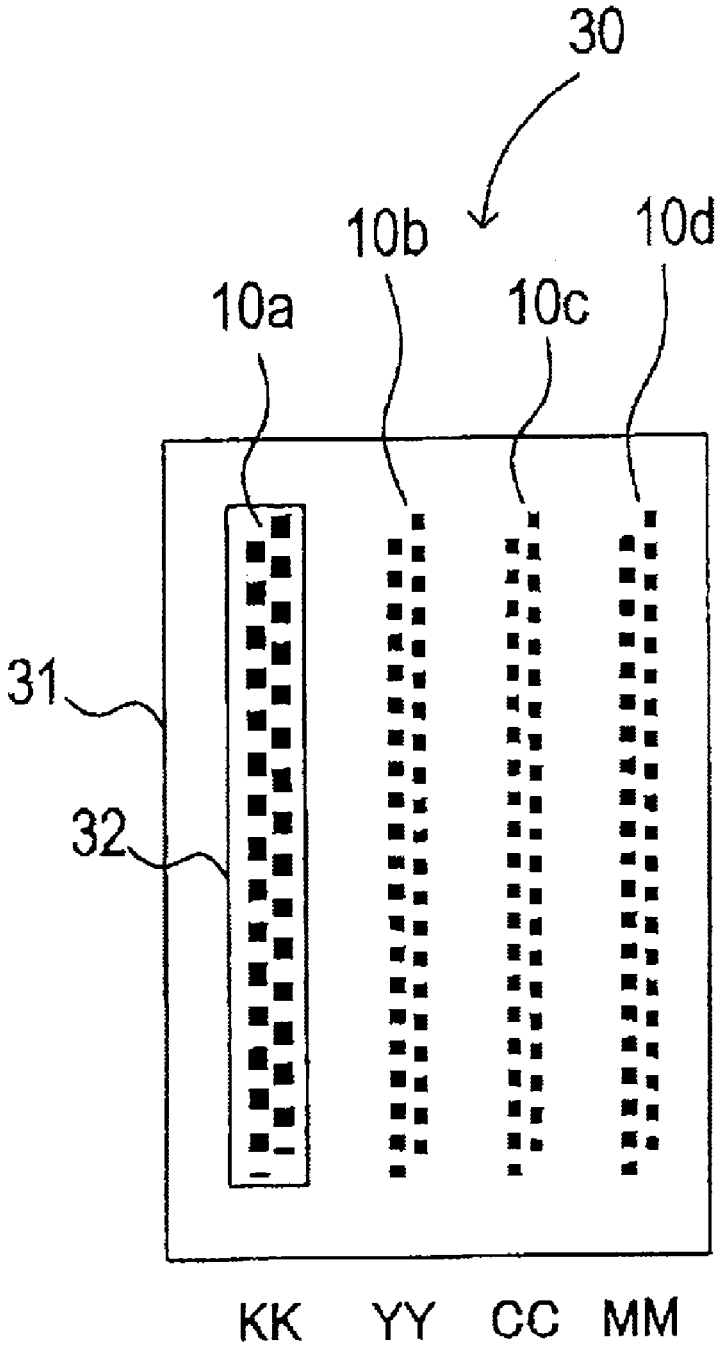
FIG. 6 is a schematic view of the cap member that is in sealing contact with a nozzle plate formed with a plurality of nozzle arrays.

FIG. 6 is a schematic diagram showing a positional relationship between cap member 30 and nozzle arrays 10*a*-10*d* when cap member 30 is in sealing contact with nozzle plate 9. Nozzle plate 9 is provided with nozzle arrays 10*a*-10*d* for inks of four colors (e.g., black, yellow, cyan, and magenta). Each of first lip 31 and second lip 32 has two opposed elongate portions that are parallel with nozzle arrays 10*a*-10*d*, and two opposed end portions that connect the two opposed elongate portions. As shown in FIG. 6, when cap member 30 is in sealing contact with nozzle plate 9, a portion of the second lip 32 parallel with nozzle arrays 10*a*-10*d* is located at a boundary portion defined between two adjacent nozzles arrays 10*a*, 10*b*. Accordingly, even when second lip 32 is made thick enough to bear a negative pressure during ink withdrawal, an interval between two adjacent nozzle arrays 10*a*, 10*b* may be reduced. Consequently, a plurality of nozzle arrays may be arranged in higher density in nozzle plate 9, thereby enabling downsizing recording head 10 and producing recording head 10 at reduced cost.

In addition, because first lip 31 and second lip 32 are separate from each other and do not intersect with each other, no intersection nor step associated with an intersection are created. Accordingly, first lip 31 and second lip 32 may be readily ensured to be flush. Even when cap member 30 is pressed against nozzle plate 9 with a relatively small force, second lip 32 within first lip 31 encloses nozzle array 10*a*, and first lip 31 encloses nozzle arrays 10*b*-10*d*, as well as nozzle array 10*a* which is enclosed by second lip 32. In this case, even when first lip 31 and second lip 32 differ slightly in height from each other, such a difference may be accommodated by pressing cap member 30 against nozzle plate 9 with a relatively small force because of the lack of an intersection.

When ink is withdrawn from the nozzle arrays to restore ejection performance, ink is withdrawn from nozzle arrays 10*b*-10*d* through hole 36 provided in first enclosed space 33, and ink is withdrawn from nozzle array 10*a* through hole 37 provided in second enclosed space 34. Thus, ink may be withdrawn separately from first enclosed space 33 and from second enclosed space 34, thereby reducing the amount of waste ink.

Figure 7A:
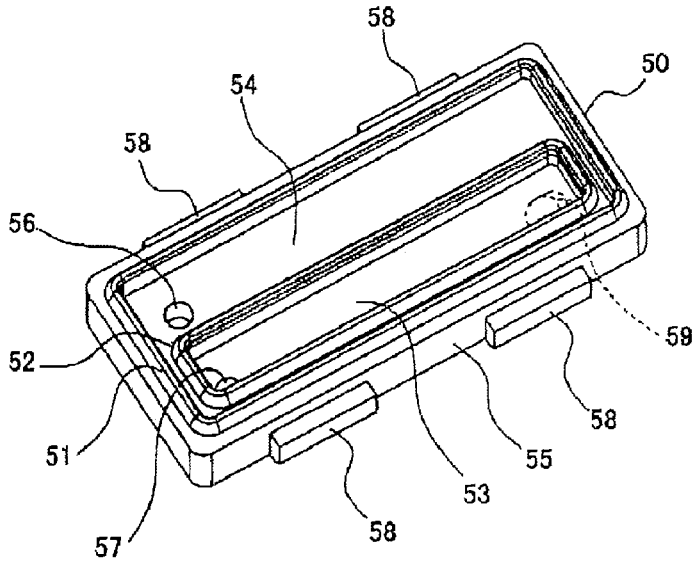
FIG. 7A is a perspective view of a cap member according to another embodiment of the present invention as viewed from a lip side.
Figure 7B:
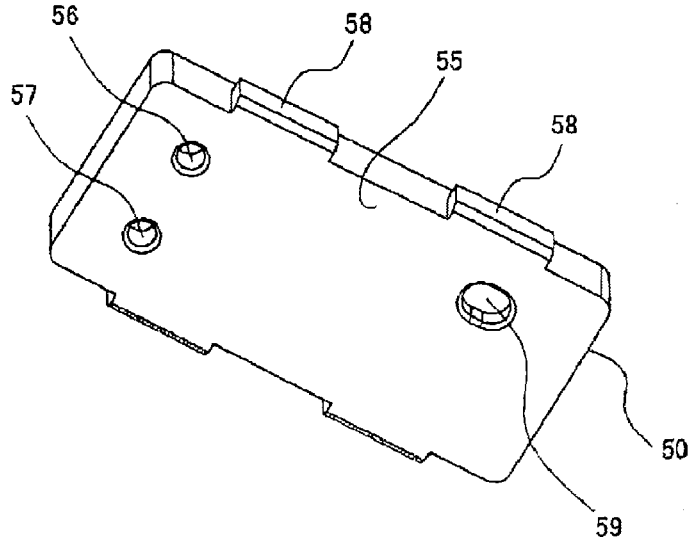
FIG. 7B is a perspective view of the cap member as viewed a side opposite to the lip.

A cap member 50 according to another embodiment of the present invention now is described with reference to FIGS. 7A and 7B. FIG. 7A is a perspective view of the cap member 50 as viewed from a side at which lips 51, 52 are formed, and FIG. 7B is a perspective view of cap member 50 as viewed from a side opposite to lips 51, 52. Cap member 50 has substantially the same structure as cap member 30 of the embodiment of the present invention depicted in FIG. 4A.

Figure 8:
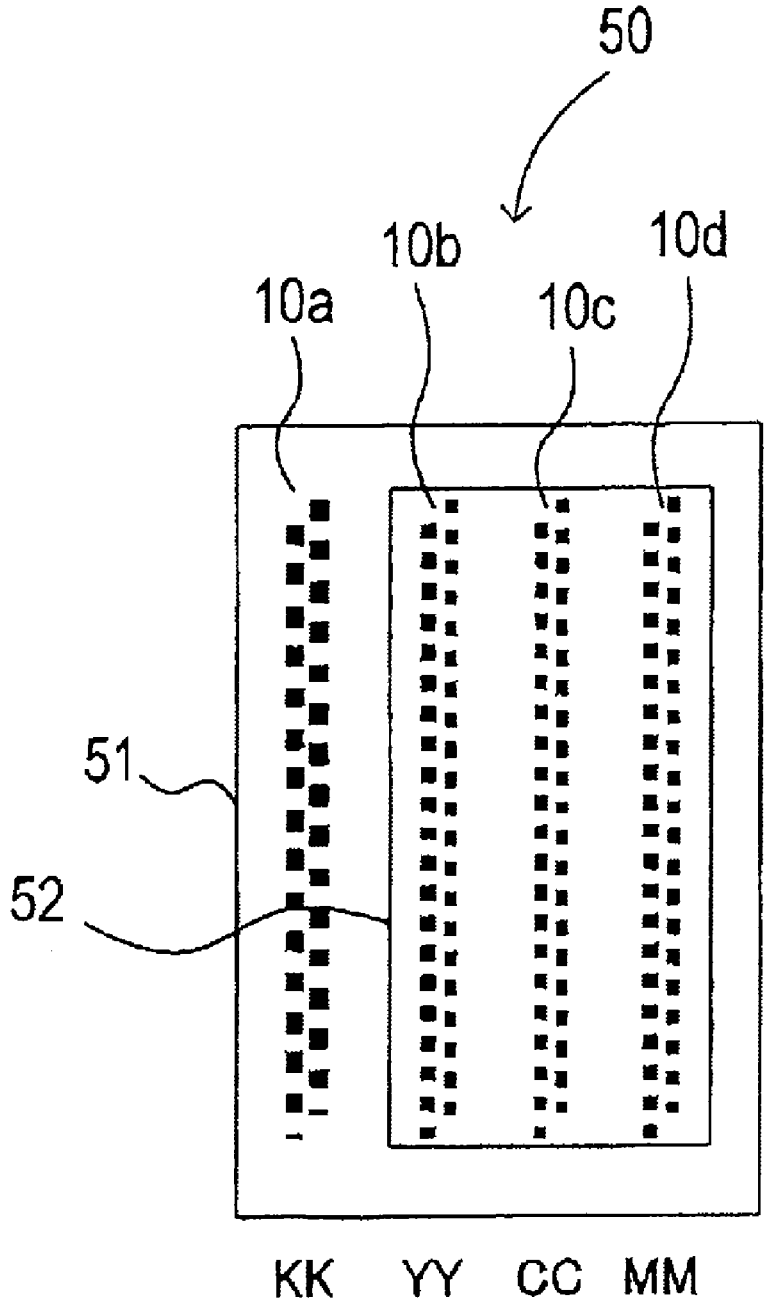
FIG. 8 is a schematic view of the cap member, according to the embodiment of the present invention depicted in FIG. 7A, that is in sealing contact with a nozzle plate formed with a plurality of nozzle arrays.

Similar to cap member 30, cap member 50 is configured to cover a recording bead having four nozzle arrays 10*a*-10*d*. As shown in FIG. 8, cap member 50 is distinguishable over cap member 30 in that a second lip 52 within first lip 51 encloses three nozzle arrays 10*b*-10*d* while first lip 51 encloses one nozzle array 10*a*, as well as three nozzle arrays 10*b*-10*d* which are enclosed by second lip 52. First lip 51 and a surface of a main body 55 opposed to nozzle plate 9 define a first enclosed space 54, and second lip 52 and the surface of main body 55 opposed to nozzle plate 9 define a second enclosed space 53. The surface of the main body 55 opposed to nozzle plate 9 has suction holes 56, 57 formed therein that communicate with first enclosed space 54 and second enclosed space 53, respectively, and through which ink is withdrawn from nozzle array 10*a* and nozzle arrays 10*b*-10*d*, respectively.

Similar to cap member 30, main body 5S, first lip 51, and second lip 52 of cap member 50 are formed integrally with each other from an elastic material, such as butyl rubber. Similar, to cap member 30, cap member 50 comprises four ribs 58 and a shallow hole 59. Cap member 50 may produce the same effects as cap member 30 of the embodiment of the present invention depicted in FIG. 4A.

Figure 9:
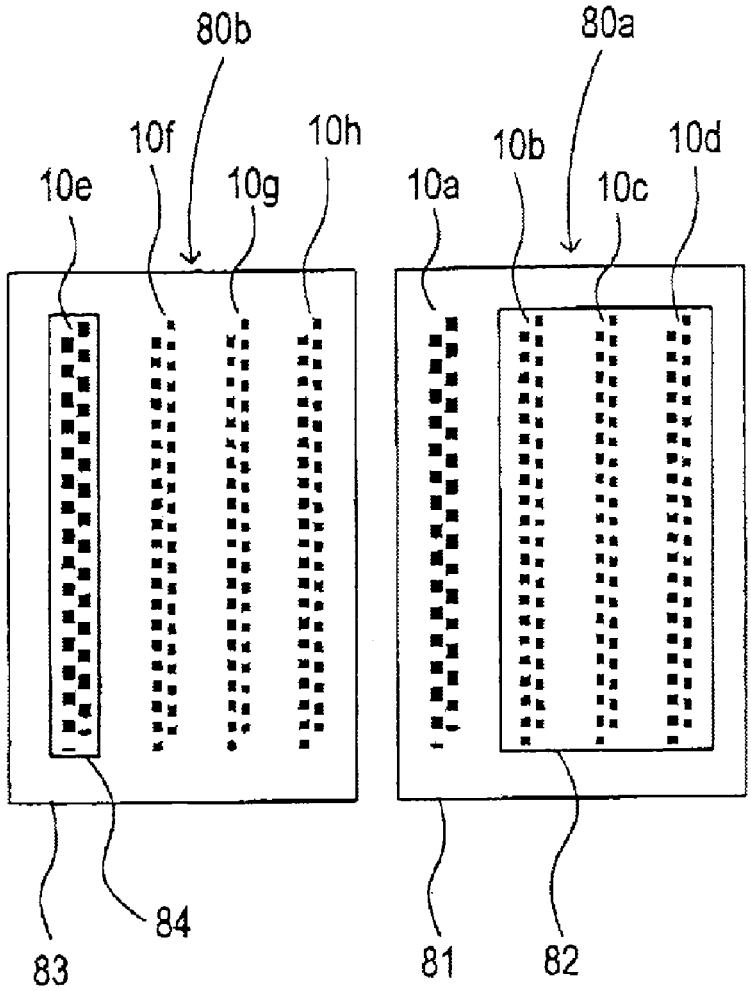
FIG. 9 is a schematic view of a cap member, according to a further embodiment of the present invention, that is in sealing contact with a nozzle plate formed with a plurality of nozzle arrays.

Cap members 80*a*, 80*b* according to a further embodiment of the present invention now is described with reference to FIG. 9-E*ight* nozzle arrays 10*a*-10*h* are covered with two cap members 80*a*, 80*b*. Within a first lip 81 of cap member 80*a*, a second lip 82 of cap member 80*a* encloses three nozzle arrays 10*b*-10*d*. Within a first lip 83 of cap member 80*b*, a second lip 84 of cap member 80*b* encloses one nozzle array 10*e*. Cap member 80*a* has the same structure as cap member 50 of another embodiment of the present invention, while cap member 80*b* has the same structure as cap member 30 of the embodiment of the present invention depicted in FIG. 4A. The cap members 80*a*, 80*b* may produce the same effects as the cap members 30, 50, respectively.

Figure 10:
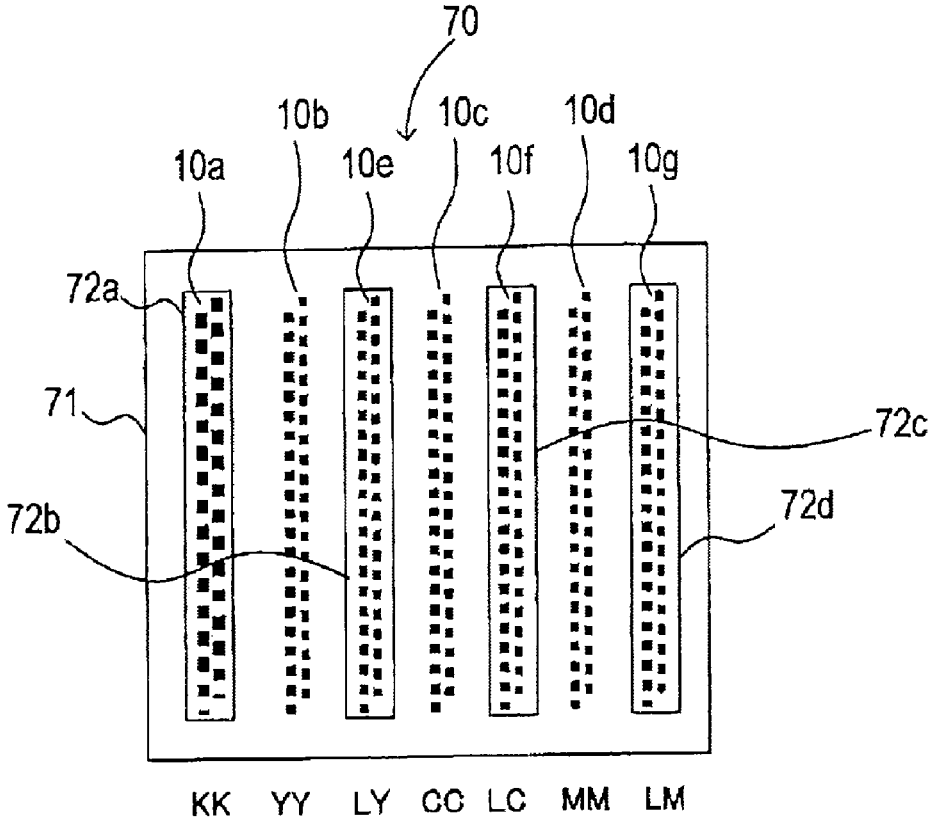
FIG. 10 is a schematic view of a cap member, according to a still another embodiment of the present invention, that is in sealing contact with a nozzle plate formed with a plurality of nozzle arrays.
Figure 11A:
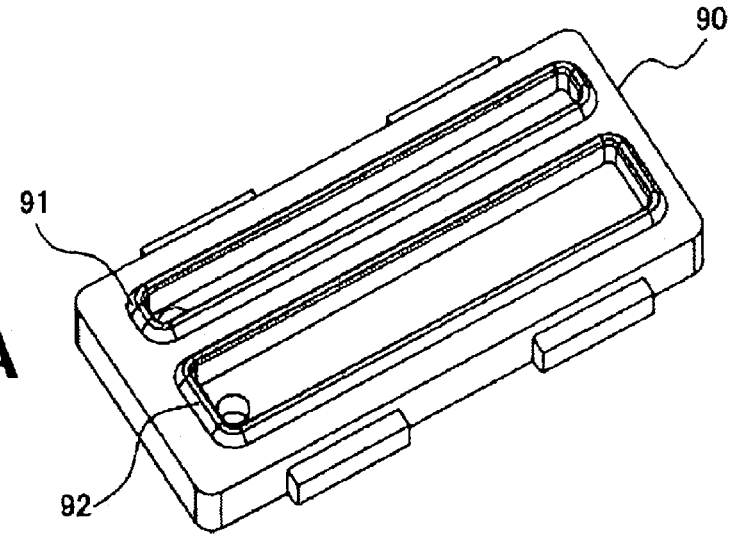
FIG.11A RELATED ART
FIG. 11A is a perspective view of a known cap member.
Figure 11B:
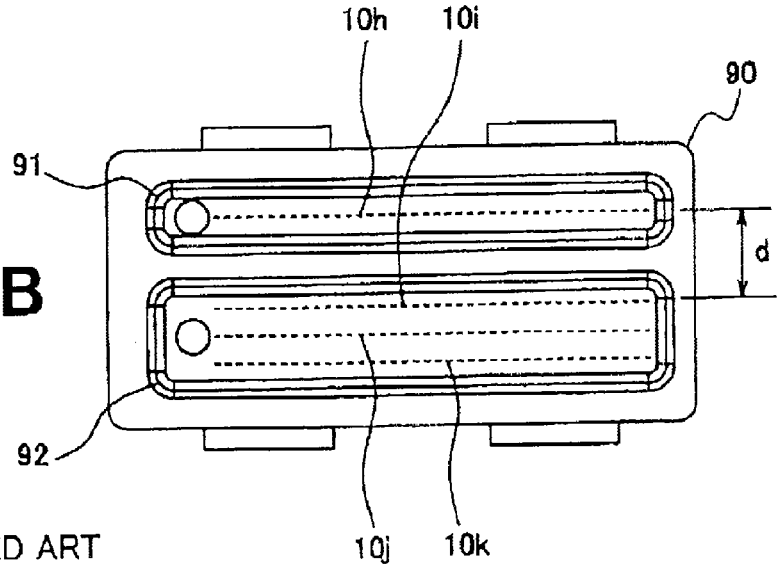
FIG.11B RELATED ART
FIG. 11B is a plan view of the known cap member.
Figure 12A:
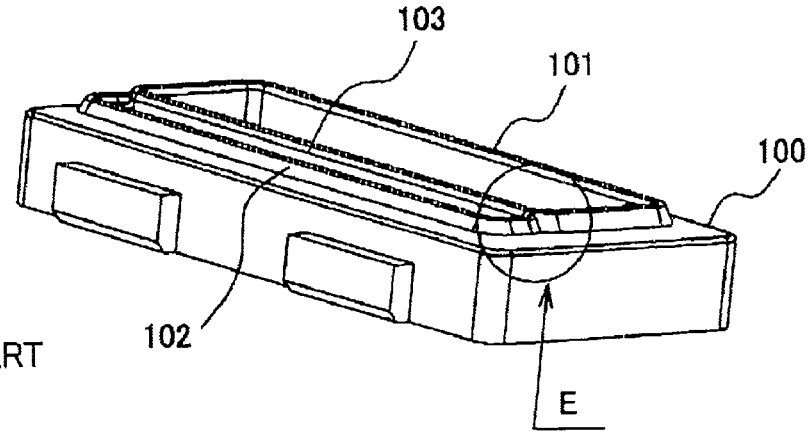
FIG. 12A is a perspective view of another known cap member.
Figure 12B:
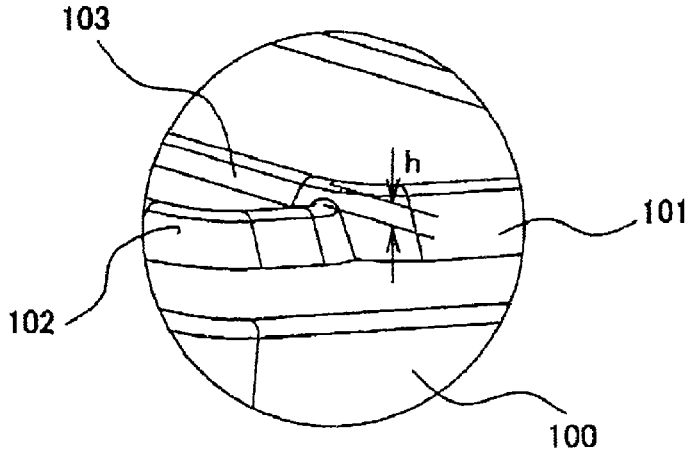
RELATED ART FIG.12B
FIG. 12B is an enlarged view of a portion E at which two lips of the cap member depicted in FIG. 12A intersect with each other.

A cap member 70 according to still another embodiment of the present invention now is described with reference to FIG. 10. As shown in FIG. 10, cap member 70 is configured to cover a recording head having seven nozzle arrays 10*a*-10*g*. Cap member 70 has substantially the same structure as cap member 30 of the embodiment of the present invention depicted in FIG. 4A and as cap member 50 of the embodiment of the present invention depicted in FIG. 7A, except that a plurality of second lips 72*a*, 72*b*, 72*c*, 72*d* are disposed within the first lip 71 separately from each other. First lip 71 encloses nozzle arrays 10*b*, 10*c*, 10*d*, while second lips 72*a*, 72*b*, 72*c*, 72*d* enclose nozzle arrays 10*a*, 10*e*, 10*f*, 10*g*, respectively. When cap member 70 covers nozzle arrays 10*a*-10*g*, two portions of second lips 72*a*-72*d*, which are parallel with nozzle arrays 10*a*-10*g*, do not abut against a single boundary portion defined between two adjacent nozzle arrays of nozzle arrays 10*a*-10*g*. Accordingly, an interval between two adjacent nozzle arrays 10*a*-10*g* may be reduced.

A main body, first lip 71, and second lips 72*a*-72*d* of cap member 70 are formed integrally with each other from an elastic material, such as butyl rubber, similarly to the embodiments of the present invention depicted in FIGS. 4A and 7A. Cap member 70 may achieve the same effects as cap members 30, 50, 80*a*, 80*b* of the embodiments of the present invention depicted in FIGS. 4A, 7A, and 9. In addition, ink may be withdrawn separately for restoring ejection performance by dividing nozzle arrays 10*a*-10*g* into a plurality of segments. Accordingly, the amount of ink wasted during ink withdrawal may be reduced.

While the invention has been described in connection with specific embodiments, it will be understood by those skilled in the art that other variations and modifications of the embodiments described above may be made without departing from the scope of the invention. Other embodiments will be apparent to those skilled in the art from a consideration of the specification or practice of the invention disclosed herein.

For example, although, in FIG. 10, second lips 72*a*, 72*b*, 72*c*, 72*d* are disposed in a dispersed manner so as to enclose alternatives nozzle arrays, e.g., nozzle arrays 10*a*, 10*e*, 10*f*, 10*g*, respectively, each second lip may be configured to enclose a plurality of nozzle arrays that are adjacent to each other. In this case, second lips also may be disposed in a dispersed manner, such that, when cap member 70 covers nozzle arrays 10*a*-10*g*, two portions of the second lips, which are parallel with nozzle arrays 10*a*-10*g*, do not abut against a single boundary portion defined between two, adjacent nozzle arrays of nozzle arrays 10*a*-10*g*. Accordingly, an interval between two, adjacent nozzle arrays of the nozzle arrays 10*a*-10*g* may be reduced.

Further, the cap member may be applied not only to the above-described inkjet recording device, but also to various liquid ejecting devices configured to eject a liquid stored in a sub-tank from nozzles. Such liquid ejecting devices include a soldering device that ejects molten solder from its nozzles to carry out automatic soldering on printed circuit boards, an organic film forming device that ejects polymeric organic material (e, light-emitting material) to produce organic, electroluminescent (EL) displays, and a device that slurries resin and ejects slurried resin from its nozzles.

It is intended that the specification and the described examples only are considered as exemplary of the invention, with the true scope of the invention being defined by the following claims.

What is claimed is:

1. A cap member for covering a plurality of nozzle arrays formed though a nozzle plate of a liquid ejecting head, the cap member comprising: a first lip having an annular shape and configured to abut against the nozzle plate to enclose the plurality of nozzle arrays; at least one second lip having an annular shape, disposed within the annular first lip, and configured to abut against the nozzle plate to enclose at least one of the plurality of nozzle arrays separately from the first lip; and a main body configured to cooperate with the first lip and the second lip to make sealing contact with the nozzle plate, the first lip and the second lip disposed on the main body; wherein the main body comprises a surface opposed to the nozzle plate, such that when the cap member covers the plurality of nozzle arrays, the opposed surface of the main body and the first lip define a first enclosed space and the opposed surface of the main body and the at least one second lip define a second enclosed space, the opposed surface having a plurality of holes formed therethrough, each of the plurality of holes communicating with a corresponding one of the first enclosed space and the second enclosed space.

2. The cap member according to claim 1, such that when the cap member covers the plurality of nozzle arrays, the second enclosed space is in communication with at least one of the plurality of nozzle arrays enclosed by the at least one second lip, and the first enclosed space is in communication with at least one of the plurality of nozzle arrays that is not enclosed by the at least one second lip.

3. The cap member according to claim 1, wherein the main body, the first lip, and the at least one second lip are formed integrally with each other from an elastic material.

4. The cap member according to claim 1, wherein the first lip is substantially flush with the at least one second lip.

5. The cap member according to claim 1, wherein the main body has a substantially rectangular shape, and the first lip extends along side edges of the main body.

6. The cap member according to claim 1, wherein at least one second lip comprises a plurality of second lips, each comprising two, opposed portions in parallel with the plurality of nozzle arrays, and the plurality of second lips are disposed on the main body, such that when the cap member covers the plurality of nozzle arrays, any two of the opposed portions of the plurality of second lips do not abut against a single boundary portion defined between two, adjacent nozzle arrays of the plurality of nozzle arrays.

7. A liquid ejecting device comprising: a liquid ejecting head which has a nozzle plate comprising a plurality of nozzle arrays formed therethrough and which ejects a liquid from the nozzle arrays; and a cap member comprising: a first lip having an annular shape and configured to abut against the nozzle plate to enclose the plurality of nozzle arrays; at least one second lip having an annular shape, disposed within the annular first lip, and configured to abut against the nozzle plate to enclose at least one of the plurality of nozzle arrays separately from the first lip; and a main body configured to cooperate with the first lip and the second lip to make sealing contact with the nozzle plate, the first lip and the second lip disposed on the main body; wherein the main body comprises a surface opposed to the nozzle plate, such that when the cap member covers the plurality of nozzle arrays, the opposed surface of the main body and the first lip define a first enclosed space and the opposed surface of the main body and the at least one second lip define a second enclosed space, the opposed surface having a plurality of holes formed therethrough, each of the plurality of holes communicating with a corresponding one of the first enclosed space and the second enclosed space.

8. The liquid ejecting device according to claim 7, such that when the cap member covers the plurality of nozzle arrays, the second enclosed space is in communication with at least one of the plurality of nozzle arrays enclosed by the at least one second lip, and the first enclosed space is in communication with at least one of the plurality of nozzle arrays that is not enclosed by the at least one second lip.

9. The liquid ejecting device according to claim 7, wherein the main body, the first lip, and the at least one second lip are formed integrally with each other from an elastic material.

10. The liquid ejecting device according to claim 7, wherein the first lip is substantially flush with the at least one second lip.

11. The liquid ejecting device according to claim 7, wherein the main body has a substantially rectangular shape, and the first lip extends along side edges of the main body.

12. The liquid ejecting device according to claim 7, wherein at least one second lip comprises a plurality of second lips, each comprising two, opposed portions in parallel with the plurality of nozzle arrays, and the plurality of second lips are disposed on the main body, such that when the cap member covers the plurality of nozzle arrays, any two of the opposed portions of the plurality of second lips do not abut against a single boundary portion defined between two, adjacent nozzle arrays of the plurality of nozzle arrays.

* * * * *